US010646763B2

(12) United States Patent
Umbrell

(10) Patent No.: US 10,646,763 B2
(45) Date of Patent: May 12, 2020

(54) TRAINING BAT ASSEMBLY

(71) Applicant: Riley R. Umbrell, Rancho Dominguez, CA (US)

(72) Inventor: Riley R. Umbrell, Rancho Dominguez, CA (US)

( * ) Notice: Subject to any disclaimer, the term of this patent is extended or adjusted under 35 U.S.C. 154(b) by 353 days.

(21) Appl. No.: 15/173,588

(22) Filed: Jun. 3, 2016

(65) Prior Publication Data

US 2017/0348575 A1 Dec. 7, 2017
US 2019/0022490 A9 Jan. 24, 2019

Related U.S. Application Data

(60) Provisional application No. 62/171,226, filed on Jun. 4, 2015.

(51) Int. Cl.

| | |
|---|---|
| ***A63B 69/00*** | (2006.01) |
| ***A63B 60/50*** | (2015.01) |
| ***A63B 15/00*** | (2006.01) |
| ***A63B 59/56*** | (2015.01) |
| ***A63B 71/06*** | (2006.01) |
| *A63B 102/32* | (2015.01) |
| *A63B 102/02* | (2015.01) |
| *A63B 102/18* | (2015.01) |

(Continued)

(52) U.S. Cl.

CPC ..... *A63B 69/0002* (2013.01); *A63B 15/00* (2013.01); *A63B 59/56* (2015.10); *A63B 60/50* (2015.10); *A63B 71/0622* (2013.01); *A63B 15/005* (2013.01); *A63B 2069/0008* (2013.01); *A63B 2102/02* (2015.10); *A63B 2102/04* (2015.10); *A63B 2102/14* (2015.10); *A63B 2102/16* (2015.10); *A63B 2102/182* (2015.10); *A63B 2102/32* (2015.10); *A63B 2102/34* (2015.10); *A63B 2208/0204* (2013.01)

(58) Field of Classification Search

CPC ..... A63B 69/0002; A63B 2069/0008; A63B 2208/0204

USPC ..... 473/457, 422, 451, 578, 579, 233, 468; D21/723; 124/5, 16; 273/348.2, 393; 446/153, 572, 176

See application file for complete search history.

(56) References Cited

U.S. PATENT DOCUMENTS 64,020 A * 4/1867 McMahel ..... A63B 67/22 473/508
74,479 A * 2/1868 Ames ..... A63B 67/22 473/508

(Continued)

FOREIGN PATENT DOCUMENTS

FR 2596997 A1 * 10/1987 ..... A63B 65/12

*Primary Examiner* — Mitra Aryanpour
(74) *Attorney, Agent, or Firm* — Fitzsimmons IP Law

(57) ABSTRACT

A training bat assembly for improving a user's swing of a baseball bat is provided. In one embodiment, the assembly includes a bat portion and a plug or cap portion, where the plug or cap portion is configured to mate with a distal end of the bat portion. For example, the bat may include a circular opening, and the plug may include a circular rod that is configured to fit within the opening. Alternatively, a cap with a circular opening can be used, where the cap is configured to fit over a distal end of the bat. By mating the plug or cap with the bat, and swinging the bat from a first position to a second position, the plug or cap is propelled from the bat, where the resulting location of the plug or cap can be used to determine the correctness of the user's swing was.

20 Claims, 7 Drawing Sheets

(51) Int. Cl.

| | |
|---|---|
| *A63B 102/16* | (2015.01) |
| *A63B 102/04* | (2015.01) |
| *A63B 102/14* | (2015.01) |
| *A63B 102/34* | (2015.01) |

(56) References Cited

U.S. PATENT DOCUMENTS 330,972 A * 11/1885 Ewing ..... A63B 67/22 473/507
578,491 A * 3/1897 Knowles ..... A63B 59/20 473/513
674,303 A * 5/1901 Morgan ..... A63B 67/22 473/507
1,075,041 A * 10/1913 Kirkness ..... F41B 3/00 124/5
1,168,808 A * 1/1916 Von Hoffmann ..... F41B 3/00 473/578
1,547,104 A * 7/1925 Dougherty ..... F41B 3/02 124/16
1,556,794 A * 10/1925 Manson ..... A63B 67/10 473/506
1,667,123 A * 4/1928 Koller ..... A63B 65/122 473/511
1,905,932 A * 4/1933 Foster ..... A63B 59/30 124/31
1,978,137 A * 10/1934 Kohn ..... A63B 59/20 473/614
2,119,524 A * 6/1938 Yew ..... F42B 4/16 473/578
2,166,115 A * 7/1939 Bergenn ..... A63B 67/22 473/508
D136,869 S * 12/1943 Garcia ..... D21/465
2,403,522 A * 7/1946 Goldstein ..... A63F 9/02 124/4
2,498,509 A * 2/1950 Santiago ..... A63B 67/205 473/506
2,705,148 A * 3/1955 Waller ..... A63B 59/30 124/5
2,821,397 A * 1/1958 Hartigan, Sr. ..... F42B 6/00 473/582
2,902,023 A * 9/1959 Waller ..... A63B 59/30 473/514
2,977,123 A * 3/1961 Buh, Jr. ..... A63F 7/382 473/507
2,993,696 A * 7/1961 Demaline ..... A63B 67/12 473/516
3,115,129 A * 12/1963 Merriman ..... A63B 59/20 124/5
3,437,340 A * 4/1969 Grise ..... F42B 6/003 473/200
3,557,768 A * 1/1971 Lake ..... F41B 3/00 124/5
3,591,179 A * 7/1971 Pentek ..... A63H 1/12 473/507
3,691,674 A * 9/1972 Thompson ..... A63H 27/12 473/586
3,797,472 A * 3/1974 Knisely, Jr. ..... A63B 67/18 473/579
3,801,102 A * 4/1974 Lohr ..... F42B 6/003 473/572
3,841,292 A * 10/1974 Hoffman ..... F41B 3/00 124/5
3,897,068 A * 7/1975 Staples ..... A63B 15/005 473/233
4,084,820 A * 4/1978 Olson, Jr. ..... A63B 65/122 124/56
D257,633 S * 12/1980 Garcia ..... 473/506
4,266,781 A * 5/1981 Blue ..... A63F 9/0278 473/575
4,291,663 A * 9/1981 Buck ..... A63B 69/407 124/26
4,302,017 A * 11/1981 Huqueriza ..... A63B 60/00 473/510
4,364,371 A * 12/1982 Woolard ..... F41B 3/00 124/5
4,776,596 A * 10/1988 Nojima ..... A63B 43/00 473/165
4,794,905 A * 1/1989 Woolard ..... F41B 3/00 124/5
4,819,935 A * 4/1989 Dirksing ..... A63B 15/00 473/457
4,946,172 A * 8/1990 Wong ..... F42B 6/003 473/585
5,230,650 A * 7/1993 Brayton ..... A63B 67/06 473/570
5,290,041 A * 3/1994 Kettelson ..... A63B 67/06 473/574
5,403,225 A * 4/1995 Watkins ..... A63H 37/00 124/5
5,522,372 A * 6/1996 Gerstikov ..... A63B 60/06 124/5
5,556,319 A * 9/1996 Watkins ..... A63H 37/00 124/5
5,928,053 A * 7/1999 Henderson ..... A63B 67/007 446/475
6,068,260 A * 5/2000 Dean ..... A63B 67/06 473/586
6,159,117 A * 12/2000 Chan ..... F42B 6/003 446/34
6,568,985 B1 * 5/2003 Binkley ..... A63H 27/005 446/176
6,638,172 B1 * 10/2003 Demars ..... F41B 15/00 463/47.2
6,808,436 B1 * 10/2004 Siu ..... A63H 27/005 124/38
6,997,770 B2 * 2/2006 Lapointe ..... F41B 11/00 124/66
D562,411 S * 2/2008 Jones ..... D21/387
7,364,521 B2 * 4/2008 Yang ..... A63B 65/02 473/572
7,631,876 B1 * 12/2009 Walterscheid ..... A63B 67/06 124/4
7,713,150 B2 * 5/2010 Hart ..... A63B 43/00 473/468
7,775,849 B2 * 8/2010 Wong ..... A63H 23/10 124/65
7,775,918 B2 * 8/2010 Tsang ..... F42B 6/10 473/572
7,849,627 B2 * 12/2010 Wygant ..... F41B 11/89 124/56
7,861,657 B2 * 1/2011 Danon ..... F42B 12/34 473/582
8,012,049 B1 * 9/2011 Walterscheid ..... F42B 6/08 473/572
8,167,741 B1 * 5/2012 Murken ..... A63B 57/16 473/387
8,517,004 B2 * 8/2013 Walterscheid ..... F41A 21/20 124/64
8,528,502 B1 * 9/2013 Gao ..... A01K 15/025 119/707
8,771,106 B1 * 7/2014 Boulanger ..... A63B 43/007 473/422
8,939,136 B2 * 1/2015 Gaus ..... F41F 7/00 473/569
9,016,520 B2 * 4/2015 Orlowski ..... A63H 23/10 446/153
D841,100 S * 2/2019 Smith ..... A63B 67/10 D21/465
10,408,584 B2 * 9/2019 Isenmann ..... F42B 6/08 473/569
2006/0046877 A1 * 3/2006 Gajda, Jr. ..... F42B 6/10 473/572
2006/0063616 A1 * 3/2006 Nye ..... A63B 47/02 473/451
2007/0000942 A1 * 1/2007 Wong ..... A63H 23/10 222/79

(56) References Cited

U.S. PATENT DOCUMENTS

| | | | | |
|---|---|---|---|---|
| 2007/0001401 | A1* | 1/2007 | Pia | A63F 9/00 273/447 |
| 2008/0020873 | A1* | 1/2008 | Miller | A63B 21/0602 473/575 |
| 2008/0051002 | A1* | 2/2008 | Wong | A63H 29/165 446/473 |
| 2009/0011870 | A1* | 1/2009 | Neal | A63B 43/00 473/451 |
| 2010/0255939 | A1* | 10/2010 | York | A63B 43/00 473/451 |
| 2014/0024482 | A1* | 1/2014 | Smith | A63B 67/10 473/506 |
| 2014/0121041 | A1* | 5/2014 | Bardin | A63B 69/0002 473/457 |
| 2015/0137454 | A1* | 5/2015 | Burks | A63B 7/24 473/510 |
| 2015/0141181 | A1* | 5/2015 | Chia | F42B 6/08 473/582 |
| 2017/0348575 | A1* | 12/2017 | Umbrell | A63B 69/0002 473/457 |

* cited by examiner

TRAINING BAT ASSEMBLY

RELATED APPLICATIONS DATA

This application claims priority pursuant to 35 U.S.C. § 119(e) to U.S. provisional patent application, Ser. No. 62/171,226, filed Jun. 4, 2015, the subject matter of which is incorporated by reference herein in its entirety.

BACKGROUND OF THE INVENTION

1. Field of the Invention

The invention relates generally to an apparatus for teaching a person to properly swing a baseball bat or the like, or more particularly, to a training apparatus comprising a bat having a plug or cap, wherein the plug or cap becomes separated (or thrown) from the bat upon swinging the bat from a first position to a second, wherein the resulting location of the plug or cap is indicative of the user's swing of the bat (e.g., indicating whether the user's swing was proper, improper, etc.).

2. Description of Related Art

It's been said that the hardest single thing to do in sports is to hit a baseball. A batter faces the challenge of synchronizing the swing of his bat with the exact time and location of the ball's arrival at home plate. The goal of the batter is to develop a short, powerful, accurate, and repeatable swing. This requires in general a proper batter's stance, a coil and step, and then coordination of the batter's hips, arms and hands to uncoil the stored power and contact the pitched ball with the "sweet spot" of the barrel of the bat.

Many techniques and training devices have been developed to assist the batter in developing a proper swing and improving the power in that swing. These training devices include weighted bats that may be used to increase strength and develop muscle memory, and bats with sliding parts, such as movable hand grips and weights that assist the batter in improving his swing technique by ensuring correct positioning of the batter's hands. Other training devices include non-standard bats, such as bats having handles, throats and/or barrels having non-circular cross-sections, as well as training devices that require someone to hold a baseball to be swung at by the batter using a modified form of a baseball bat. However, many of these training devices are directed only to a single aspect of a batter's swing (e.g., strength, etc.) and not the complete swing.

There are several elements that make up a correct batter's swing, and there are as well different schools of thought as to what these elements should be. However, in general, a correct swing starts with a stride from the batter's stance, whereupon the batter starts his swing with his leading hand and arm (the left hand and arm in the case of a right-handed batter). The leading hand and arm lead the swing, doing most of the work, with the left elbow unlocked and the left hand pulling out to contact the baseball in the strike zone. In other words, the bottom hand pulls the handle of the bat and guides the barrel of the bat into the proper position to make contact with the baseball.

When the barrel of the bat makes contact with the baseball, the bat is generally horizontal with the playing field and the top (right) hand is palm up and "pushing," the bottom (left) hand is palm down and "pulling," and the knuckles of one hand are aligned with the knuckles of the other. And preferably the wrists are not rolled until contact is made with the baseball.

Given that the pitcher pitches off of a 10" high mound, usually the baseball will approach the batter diagonally downward. Nevertheless, the preferred swing is one that is flat, i.e., one that is contained within a plane horizontal to the playing field. Another choice is to use a slight upstroke that matches the trajectory of the incoming pitch. Other coaches teach swinging down, with the idea being that if the batter swings on a downward plane (in an effort to shorten his swing), his chances of contacting the baseball are increased and with ground balls there is always the possibility of fielding errors.

After contact with the baseball, the speed of the bat continues to accelerate, the back elbow starts to straighten out as a result of pushing from the top (right) hand. The swing finishes with both arms extended into the so-called "Power V" position.

Because of the various shortcomings in known baseball bat training tools, there is a need for an improved baseball bat training apparatus that is relatively easy to manufacture, relatively easy to use (e.g., without needing the assistance of others, can be used by all age groups, can be used indoors, etc.), and will improve several elements of the batter's swing.

SUMMARY OF THE INVENTION

The present invention provides a system and method for improving a user's swing of an apparatus, such as a baseball bat. In a preferred embodiment of the present invention, the system involves a bat portion and a plug or cap portion, wherein the plug or cap portion is configured to mate with a distal end of the bat portion. By mating the plug or cap with the bat, and swinging the bat from a first position to at least a second position, the plug or cap is thrown (or propelled) from the bat, where the resulting location of the plug or cap can be used to determine whether the user's swing was correct.

In one embodiment of the present invention, the system includes a first cylindrical portion (e.g., a bat portion) and a second cylindrical portion (e.g., a plug portion), wherein the two portions are loosely mated together. The first cylindrical portion has a proximal end and a distal end, where the distal end includes a first mating portion, such as a circular opening. The second cylindrical portion includes a second mating portion, such as a circular rod attached to a top, wherein the second mating portion is configured to loosely mate with the first mating portion. This allows the second cylindrical portion to remain mated with the first cylindrical portion when a distal end of the first cylindrical portion is in a first position, and to separate from first cylindrical portion when the distal end of the first cylindrical portion is swung from the first position to at least a second position.

In this embodiment, the first cylindrical portion may resemble a baseball bat having a handle, a throat, and/or a barrel, wherein the barrel has a diameter that is larger than the diameter of the handle and/or throat, and the circular opening has a diameter that is smaller than the diameter of the barrel. In the second cylindrical portion, the diameter of the rod is smaller than the diameter of the top, and the diameter of the rod is slightly smaller than the diameter of the circular opening. By making the rod slightly smaller than the opening, the rod can be placed within the opening, will stay within the opening when the first cylindrical portion is in a first position, and will fall out of (or be thrown from) the opening when the distal end of the first cylindrical portion is swung from the first position to at least the second position.

In alternate embodiments of the present invention, the system includes a first cylindrical portion whose diameter is relatively consistent throughout (e.g., the bat portion has substantially the same diameter at the handle as it does at the barrel and/or the throat). In these embodiments the distal end of the first cylindrical portion may be unaltered, have a circular opening, or a reduced diameter, and the second cylindrical portion may resemble a plug or a cap. For example, the second cylindrical portion may be a plug that includes a rod, and may further include a top (e.g., a flat top, a top that resembles a baseball, etc.), wherein the rod is configured to fit inside the circular opening of the first cylindrical portion. In other examples, the second cylindrical portion may be a cap having a circular opening, where the circular opening is configured to fit over the distal end of the first cylindrical portion (e.g., as unaltered, as reduced in diameter, etc.).

In all embodiments, the first cylindrical portion and the second cylindrical portion are configured to loosely mate together, allowing the portions to remain together when the distal end of the first cylindrical portion is in a first position, and to separate when the distal end of the first cylindrical portion is swung from the first position to a second position. For example, the first position may include a position where the distal end of the first cylindrical portion (e.g., the far end of the bat portion) is vertically above the user's head and/or shoulders, and horizontally at or behind the user's body. The second position may include a position where the distal end of the first cylindrical portion (e.g., the far end of the bat portion) is vertically below the user's head and/or shoulders, and horizontally in front of the user's body. In a typical baseball swing, the batter will hold the bat in the first position and swing the bat to the second position. It is this swing that results in the plug/cap portion being separated from the bat portion of the assembly. As the batter swings the bat from the first position to the second position, the plug/cap portion will be propelled away from the batter and/or the bat, where the resulting direction and distance of the plug/cap is indicative of the user's swing.

In one embodiment of the present invention, the system further includes a layout having a plurality of markings, some of which are standard baseball diamond markings (e.g., first base, second base, etc.), and some of which are non-standard baseball diamond markings (e.g., at least one circle around or near home plate, at least one circle near the first base dugout, at least one circle around or near the pitcher's plate, etc.). The non-standard markings help the user determine whether their swing is correct. For example, in the case of a right-handed batter, if the batter swings with an "arm bar," "long arms," or too much chest rotation, then the plug/cap will be propelled into a circle near the first based dugout, if the batter drops his hands low and then swings up, or drops his hands and then swings flat, then the plug/cap will fall into a circle around or near home plate, and if the batter swings correctly, then the plug/cap will be propelled into a circle around or near the pitcher's plate. By noting where the plug/cap falls, the batter is able to adjust and correct his/her swing until all of his/her swings result in the plug/cap being directed toward the pitcher's mound.

A more complete understanding of a system and method for improving a user's swing of an apparatus, such as a baseball bat, will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention is directed toward a system and method for improving a user's swing of an apparatus. While the apparatus is described herein in terms of a training (or baseball) bat, the present invention is not so limited. For example, the present invention could also be used to improve a user's swing of an instrument used in any sporting event, such as softball, t-ball, tennis, racquetball, table-tennis, badminton, golf, lacrosse, polo, and the like. The invention could also be used, in and of itself, as a game or a source of entertainment for at least one user.

In a preferred embodiment of the present invention, the system involves a bat portion and a plug or cap portion, wherein the plug or cap portion is configured to mate with a distal end of the bat portion. By mating the plug or cap with the bat, and swinging the bat from a first position (e.g., a load position) to a second position (e.g., a contact or extend position), the plug or cap is separated (or thrown) from the bat. The resulting location of the plug or cap (or it relationship to the user and/or bat) can then be used to determine whether the user's swing was correct (or proper) or incorrect (or improper). Before discussing the invention in further detail, a brief discussion of different types of swings will first be provided.

The most common incorrect swings are (1) the "arm bar" (this occurs when the batter swings with a stiff straight front arm with a locked elbow), (2) "long arms" (this occurs when the batter swings but his arms are reaching too far away from his body but not totally straight), (3) the "dropped-hands upper cut" swing (this occurs when the first motion the batter does is to drop his hands low then swing up), (4) the "dropped-hands flat" swing (this is a swing where the first motion the batter does is to drop his hands and then swing flat), and (5) too much chest rotation (this occurs when the batter's chest opens up first and he drags his hands though the strike zone).

By use of the present invention, the user can determine not only whether his/her swing is incorrect, but if it is, why it's incorrect. For example, if an arm bar occurs, the plug or cap will fly out straight away from the batter, or toward the first base dugout for a right-handed batter, or toward the third base dugout for a left-handed batter. If a long arm occurs, the plug or cap will fly out straight away from the batter, or toward first base for a right-handed batter, or toward third base for a left-handed batter. If the batter drops his/her hands with an upper cut, the plug or cap will fall out right next to or behind the batter. If batter drop his/her hands and then swing flat, the plug or cap will fall out behind them. If a batter swings with too much chest rotation, the rod plug will fly out away from a right-handed batter in the 1st base direction, or away from a left-handed batter in the 3rd base direction.

Figure 1A:
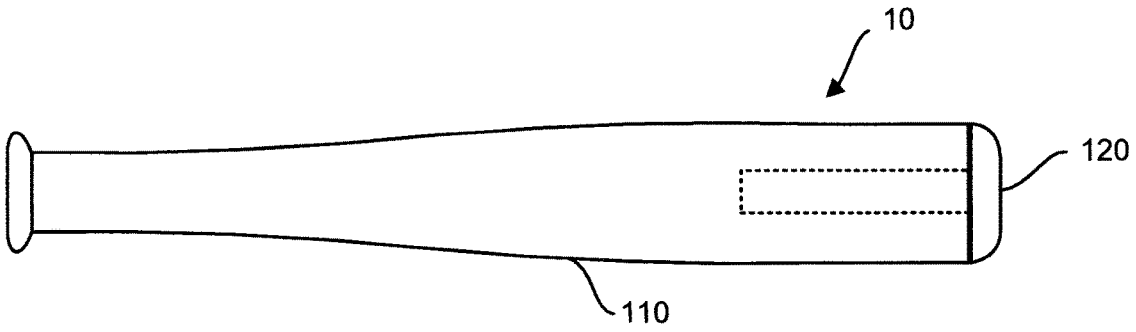
FIGS. 1*a* and 1*c* depict a training bat assembly in accordance with one embodiment of the present invention.
Figure 1B:
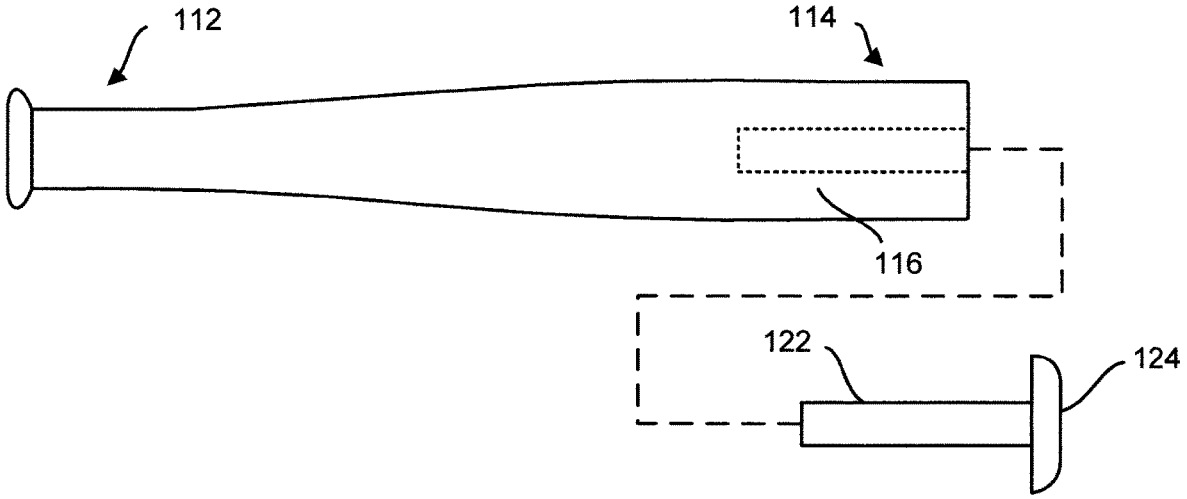
FIG. 1*b* shows an unassembled view the training bat assembly depicted in FIG. 1*a;*

FIG. 1*a* shows a training bat assembly in accordance with one embodiment of the present invention. In accordance with this embodiment, the assembly 10 includes a first cylindrical portion 110 (e.g., a bat portion) and a second cylindrical portion 120 (e.g., a plug portion), wherein the two portions are loosely mated together. As shown in FIG. 1*b*, the first cylindrical portion 110 has a proximal end 112 and a distal end 114, where the distal end 114 includes a first mating portion, such as an aperture 116 (e.g., a circular shaft or opening). The second cylindrical portion 120 includes a second mating portion, such as a circular rod 122, and a top 124, wherein the second mating portion 122 is configured to loosely mate with the first mating portion 116. This allows the second cylindrical portion 120 to remain mated the first cylindrical portion 110 when the first cylindrical portion 110 is in a first position (e.g., a load position), and to separate from the first cylindrical portion 110 when the first cylindrical portion 110 is swung from the first position to a second position (e.g., a contact or extend position).

Figure 2A:
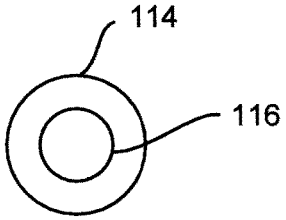
FIG. 2*a* illustrates a distal-end-view of the bat portion of the training bat assembly depicted in FIG. 1*b;*
Figure 2B:
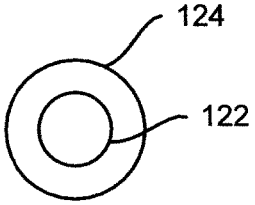
FIG. 2*b* illustrate a proximal-end-view of the plug portion of the training bat assembly depicted in FIG. 1*b;*

As shown in FIG. 1*a*, the first cylindrical portion 110 may resemble a baseball bat having a handle, a throat, and/or a barrel, wherein the barrel has a circumference (or diameter) that is larger than the circumference (or diameter) of the handle and/or throat; the handle being the portion of the bat held by the user (e.g., via the user's hands), the barrel being the portion of the bat that comes into contact with the ball, and the throat being the portion of the bat between the handle and the barrel. As shown in FIG. 2*a*, the distal end 114 of the first cylindrical portion 110 includes an aperture 116, wherein the circumference (or diameter) of the aperture 116 is smaller than the circumference (or diameter) of the distal end 114 of the first cylindrical portion 110. As shown in FIG. 2*b*, the second cylindrical portion 120 includes a rod 122 and a top 124, wherein the circumference (or diameter) of the rod 122 is smaller than the circumference (or diameter) of the top 124, and is substantially the same as (e.g., slightly smaller than) the circumference (or diameter) of the aperture 116. By making the rod 122 slightly smaller than the aperture 116, the rod 122 can be placed within the aperture 116, will stay within the aperture 116 when the first cylindrical portion 110 (or its distal end) is in a first position, and will leave (or be propelled out of) the aperture 116 when the first cylindrical portion 110 (or its distal end) is swung from the first position to a second position.

Figure 1C:
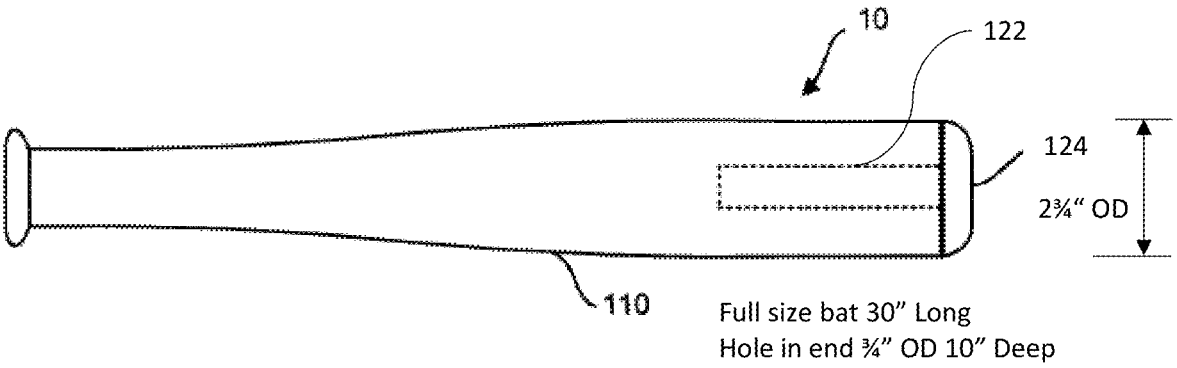
Figure 1D:
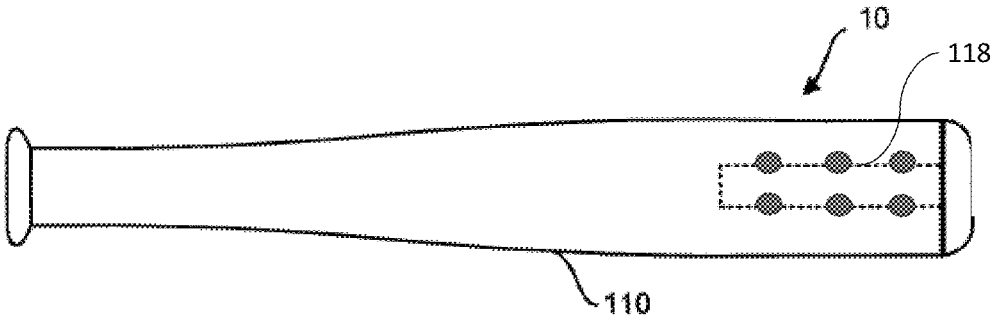
FIG. 1*d* depicts a training bat assembly in accordance with another embodiment of the present invention

For example, FIG. 1*c* shows an embodiment of a training bat 10 comprising a conventional baseball bat 110 and a rod plug 122 inserted into a cylindrical space formed in the end of the training bat 10. The rod plug 122 has at one end a knob 124 with an outer diameter larger that the diameter of the cylindrical space disposed within the end of the training bat 10, thus keeping the rod plug 122 in its proper position when inserted. In this embodiment, the training bat 10 is a full size, conventional bat with a length of 30.o in. an outside diameter 2 and ¾ in. at the end of the training bat 10. The depth of the cylindrical space disposed within the end of the bat 10, may be approximately 10.0 in., and the diameter of the cylindrical space may be approximately ¾ in. The diameter of the rod plug 122 may be slightly less than ¾ in., but in general, any diameter that allows the rod plug 122 to rest loosely in the cylindrical space is acceptable. For example, there may be a space of approximately 1/16 in. all around between the rod plug 122 and the cylindrical space within the end of the training bat 10. The rod plug 122 may also include a knob or similar shaped spherical object having an outside diameter greater that the diameter of the cylindrical space.

It should be appreciated that the present invention is not limited to the bat and/or plug portions shown in FIGS. 1 and 2. In fact, other exemplary embodiments are shown in FIGS. 3*a-f*, and are described herein. For example, the bat and/or plug portions do not have to be cylindrical, and the plug portion does not need to include a rod and/or top as depicted in FIG. 1*b*. Those skilled in the art will appreciated, however, that an extended rod (as opposed to a short rod) may improve operation of the apparatus, and the top can be used to add weight to the plug portion (allowing it to travel further when it becomes separated from the bat portion) and/or to limit a distance the rod can travel within the aperture. Those skilled in the art will also appreciated that the rod, itself, can be used to limited the distance the rod can travel within the aperture (e.g., by using a rod that is substantially the same length as the aperture). Finally, those skilled in the art should appreciated that the present invention does not need to be constructed in any particular manner, or using any particular material. For example, bat and plug portions made out of metal (e.g., aluminum, steel, lead, etc.), wood, plastic, fiberglass, carbon fiber, and/or foam are within the spirit and scope of the present invention. For example, an apparatus for use outdoors may me made out of metal or wood, whereas an apparatus made for indoor use or by young children may be made out of foam material. A bat portion made out of a first material, and a plug portion made out of a second material, is also within the spirit and scope of the present invention. If the intent is for the plug portion to travel far, the plug portion should be relatively heavy (e.g., made from wood, metal, solid, etc.). If, however, the intent is for the plug portion to not travel far, the plug portion should be relatively light (e.g., made from plastic, foam, hollow, etc.) and/or connected to the bat portion (e.g., via a short string, a short cord, etc.).

Figure 3A:
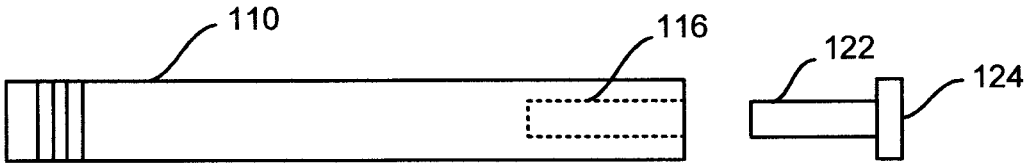
FIGS. 3*a-f* are alternate embodiments of the present invention, wherein each embodiment comprises a bat portion (e.g., a solid bat portion, a bat portion having a distal end that includes an aperture, or a bat portion having a distal end with a reduced diameter) and either a plug portion (e.g., a rod portion or a rod portion connected to a top portion (e.g., a flat top portion, a baseball portion, etc.)) or a cap portion.

A training bat assembly in accordance with a second embodiment of the present invention is depicted in FIG. 3*a*. In this embodiment, the bat portion 110 includes an aperture 116 and the plug portion includes a rod portion 122 and a top portion 124, similar to the embodiment shown in FIG. 1*a*. However, unlike the above embodiment, the bat portion 110 includes a circumference (or diameter) that is relatively uniform throughout. In other words, while the bat portion 110 includes a handle at the proximal end, and an aperture 116 at the distal end, the bat portion 110 is stick-like, in that it's circumference (or diameter) is substantially the same throughout (e.g., substantially the same at the handle as it is at the barrel, as it is at the throat). It should be appreciated, however, that certain variations within the bat's circumference is within the sprit and scope of the present invention. For example, a bat that includes grooves or a different material at the handle (e.g., to provide a better grip) is within the sprit and scope of the present invention.

Figure 3B:
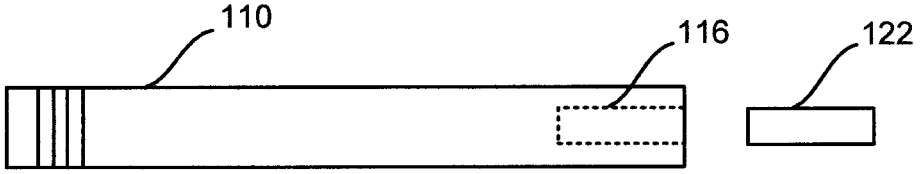

A training bat assembly in accordance with a third embodiment of the present invention is depicted in FIG. 3*b*. This embodiment is similar to the embodiment depicted in FIG. 3*a* except the plug portion does not include a top (i.e., only includes a rod 122). In this embodiment, the length of the rod 122 is substantially the same length as the aperture 116, and may be made out of a different material than the bat portion 110. For example, a bat portion 110 that is made out of wood, and a rod 122 that is made out of metal (or plastic covered metal) (to increase the rod's weight) is within the sprit and scope of the present invention. While the rod 122 is preferably cylindrical, other shapes are within the spirit and scope of the present invention. For example, a round plug (e.g., a ball) that can be placed within the aperture 116 is within the sprit and scope of the present invention.

Figure 3C:
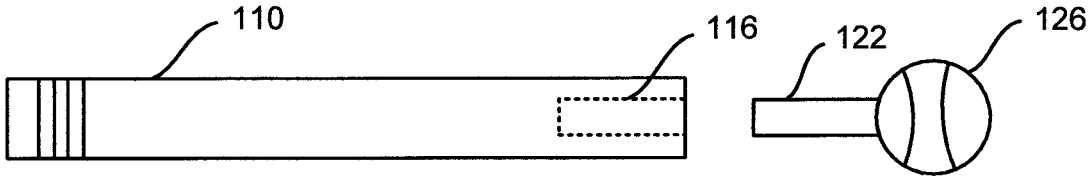

A training bat assembly in accordance with a fourth embodiment of the present invention is depicted in FIG. 3*c*. This embodiment is similar to the embodiment depicted in FIG. 3*a* except, instead of a generic (or flat) top 124, a baseball 126 (or an item that resembles a baseball) is attached to the rod 122. Such an embodiment may appeal to users who are trying to improve their baseball bat swing by providing a visual of a baseball (or something that resembles a baseball) being propelled from the bat in response to the user swinging the bat.

Figure 3D:
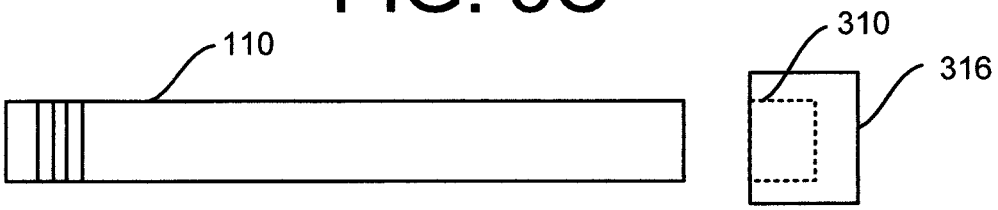

A training bat assembly in accordance with a fifth embodiment of the present invention is depicted in FIG. 3*d*. In this embodiment, no aperture is needed within the bat portion 110, and instead of a plug portion, a cap portion 310 is used, where the cap portion includes an aperture 316 whose inner circumference (or diameter) is slightly larger than the outer circumference (or diameter) of the distal end of the bat portion 110. It should be appreciated that while this embodiment includes a cap portion instead of a plug portion, both embodiments require two portions that mate together (regardless of which portion includes the aperture), and one skilled in the art would understand that modification made to the plug embodiments, as describe herein, could also be made to the cap embodiments.

Figure 3E:
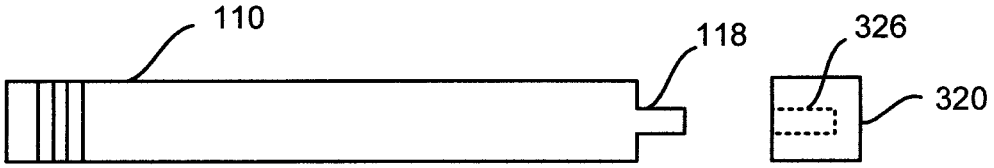

A training bat assembly in accordance with a sixth embodiment of the present invention is depicted in FIG. 3*e*. This embodiment is similar to the embodiment shown in FIG. 3*d*, except the bat portion 110 further includes a distal end 118 having a reduced circumference (or diameter). By sizing the aperture 326 of the cap to be slightly larger than the circumference (or diameter) of the distal end 118 of the bat portion 110, the outer circumference (or diameter) of the cap 320 can be substantially the same as the outer circumference (or diameter) of the non-distal portion of the bat portion 110 (i.e., resulting in an assembled training bat that has a relatively uniform circumference or diameter).

Figure 3F:
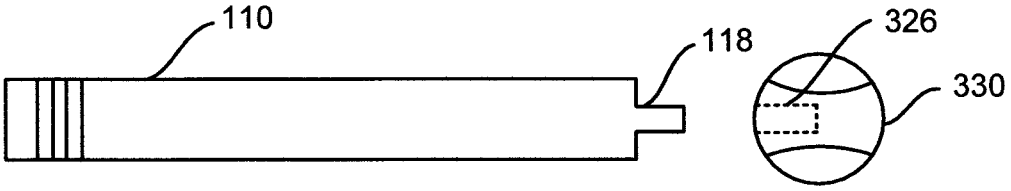

A training bat assembly in accordance with a seventh embodiment of the present invention is depicted in FIG. 3*f*. This embodiment is similar to the embodiment shown in FIG. 3*e*, except the cap 320 is a baseball 330 (or something that resembles a baseball) having an aperture 326. As with the prior embodiment, the aperture 326 should be sized to be slightly larger than the outer circumference (or diameter) of the distal end 118 of the bat portion 110. As with the fourth embodiment, this embodiment may appeal to users who are trying to improve their baseball bat swing by providing a visual of a baseball (or something that resembles a baseball) being propelled from the bat in response to user swinging the bat.

It should be appreciated that while different embodiments have been described herein, the present invention is not limited to any particular embodiment, and may include, for example, features from one embodiment, or a combination of features from different embodiments. It should also be appreciated that in all embodiments, the loose mating between the first and second cylindrical portions could be provided by merely sizing the first and second mating portions accordingly (e.g., sizing the second mating portion slightly smaller than the first mating portion) or could be enhanced through the use of other materials (e.g., materials that increase or decrease friction between the two mating portions) and/or other features (e.g., placing hook and loop fasteners on the distal end of the rod and the bottom of the shaft to help retain the plug within the aperture, placing a permanent magnet and a metal insert on the distal end of the rod and the bottom of the shaft, respectively (or visa versa), to help retain the plug within the aperture, using ball-bearings (e.g., on the side of the shaft) (see, e.g., FIG. 1D at 118) to reduce friction between the plug and the shaft, etc.). It should further be appreciated that the first and second mating portions can be sized so that second cylindrical portion separates from the first cylindrical portion when a distal end of the first cylindrical portion is angled downward (i.e., gravity is sufficient to separate the first and second cylindrical portions) or only when a distal end of the first cylindrical portion is swung from a first position to at least a second position (i.e., force generated by swinging the distal end of the first cylindrical portion from a first position to at least a second position is needed to overcome static friction between the first and second mating portions) (e.g., force>coefficient of static friction). It should also be appreciated that while the apparatus (bat and plug/cap portions) can be of any size, an apparatus or bat portion that is shorter, placing the plug/cap portion closer to the user's hands, provides more accurate results. Thus, an apparatus or bat portion that is roughly twelve inches in length (or thereabout, e.g., between eight and eighteen inches, less than twenty-four inches, etc.) is preferred. However, an apparatus that is the length of a regulation baseball bat (e.g., between thirty-two and forty-two inches) is within the spirit and scope of the present invention.

Figure 3G:
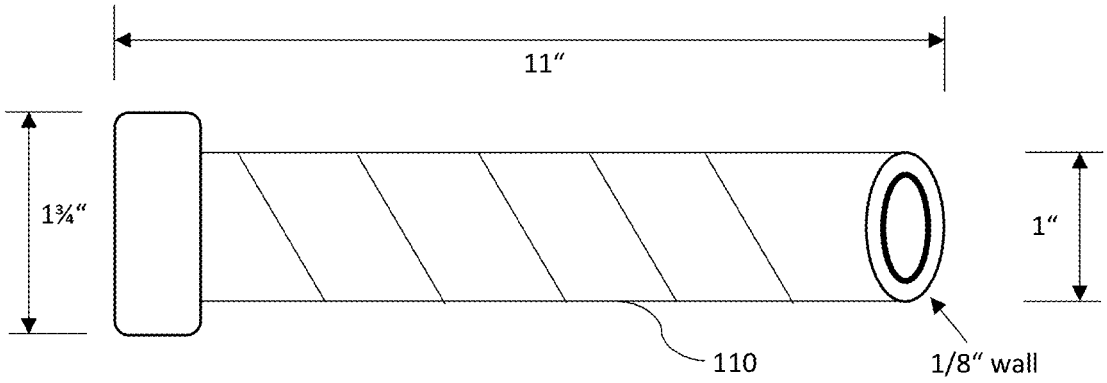
FIGS. 3*g* and 3*h* depict, respectively, a shortened baseball bat and a rod plug in accordance with certain embodiments of the present invention.
Figure 3H:
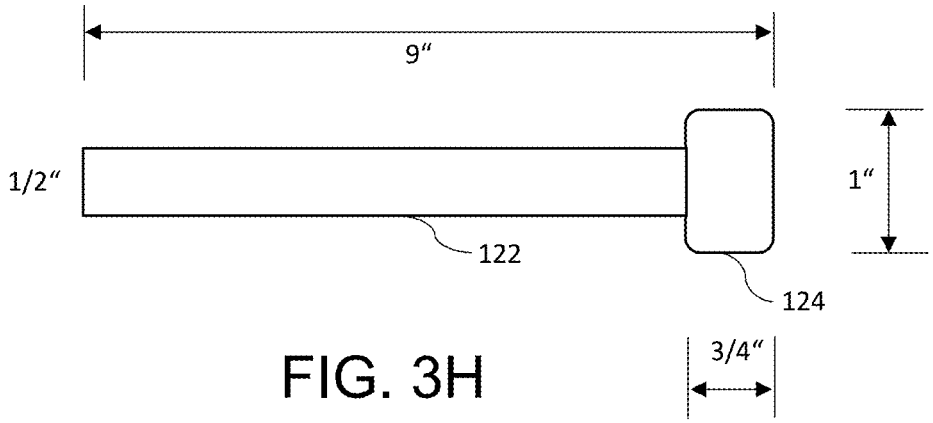

For example, with reference to FIG. 3*g*, the training bat 110 may have a length of approximately 11.0 in., and the outer diameter of approximately 1.0 in. at the open end of the training bat 110. The depth of the cylindrical space disposed within the end of the pat 110 may be approximately 8 and ¼ in., and the diameter of the cylindrical space may be approximately ¾ in. The diameter of the cylindrical portion of the rod plug 122 may be slightly less than ¾ in., so that the rod plug 122 will rest loosely in the cylindrical space disposed within the end of the bat 110. In FIG. 3*h*, the diameter of the cylindrical portion of the rod plug 122 is shown as approximately ½ in. The rod plug 122 may also include a knob or similar shaped spherical object having an outer diameter greater than the outside diameter of the cylindrical space, which in this embodiment is approximately 1.0 in.

FIGS. 3*j* and 3*k* show see-through side views of a preferred embodiment of a training bat comprising a shortened training bat 110 and a rod plug 122 inserted into a cylindrical space formed in the end of the training bat 110. in this embodiment, the training bat 110 may have a length of approximately 11.0 in., an outer diameter of approximately 1.0 in. at the open end of the training bat 110, and an outside diameter of approximately 1 and ¾ in. at the opposite closed end. The depth of the cylindrical space disposed within the end of the bat 110 may be approximately 8 and ¼ in., and the diameter of the cylindrical space may be approximately ½ in., and the diameter of the knob portion of the rod plug 122 may be approximately 1.0 in., which is approximately the same as the outside diameter of the opposite closed end of training bat 110. In general, the diameter of the cylindrical space of the training bat 110 and the diameter of the cylindrical portion of the rod plug 122 should allow the rod plug 122 to rest loosely in the cylindrical space of the training bat 122. For example, there may be a space of approximately 1/16 in. all around between the rod plug 122 and the cylindrical space within the end of the training bat 110 in other embodiments.

Figure 4A:
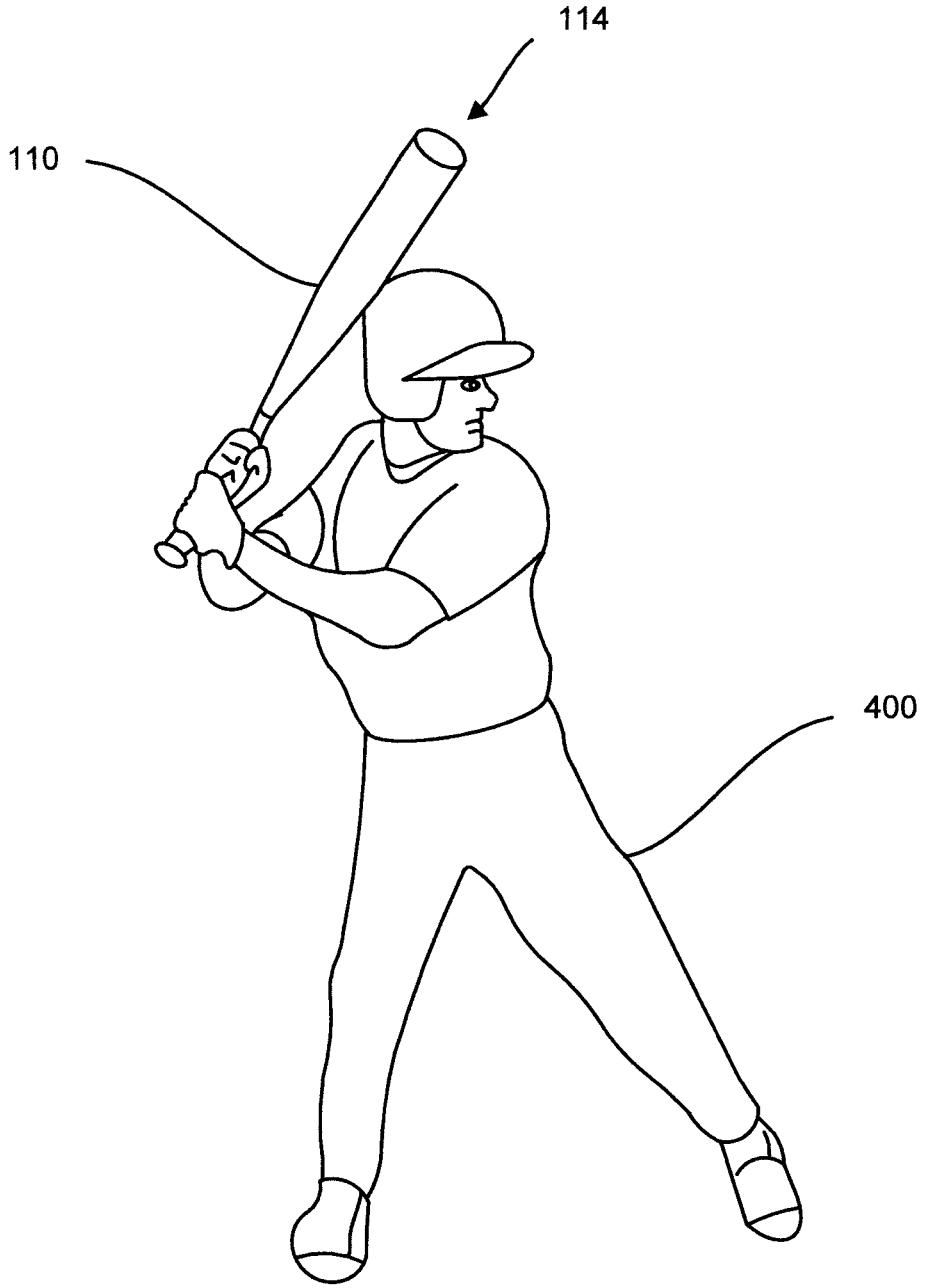
FIG. 4*a* illustrates a user holding the training bat apparatus (or distal end thereof) in a first position, in accordance with one embodiment of the present invention.
Figure 4B:
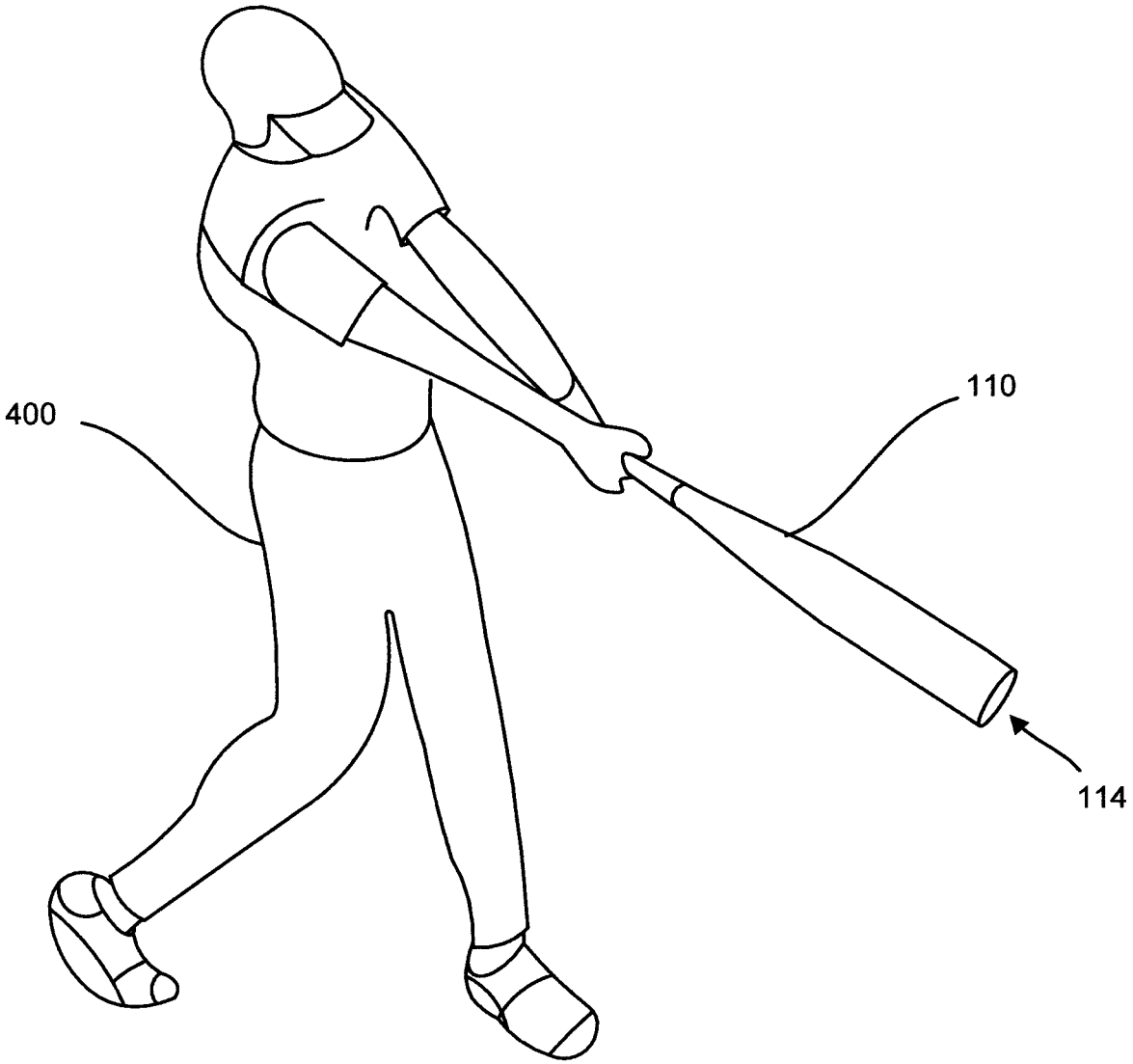
FIG. 4*b* illustrates a user holding the training bat apparatus (or a distal end thereof) in a second position, in accordance with one embodiment of the present invention.

As discussed above, the present invention may be used to improve the swing of a batter (i.e., a baseball player). FIG. 4*a* illustrates a batter 400 holding a bat portion 110 in a first position, where the distal end of the bat 114 is vertically above the user's head and shoulders, and horizontally at (or behind) the user's body. FIG. 4*b* illustrates the batter 400 holding a bat portion 110 in a second position, where the distal end of the bat 114 is vertically below the user's head and shoulders, and horizontally in front of the user's body. In a typical baseball swing, the batter will hold the bat in the first position (e.g., the load position) (see FIG. 4*a*), and swing the bat through a series of positions, ending in the second position (e.g., the contact or extend position) (see FIG. 4*b*). It is this swing (i.e., from the first to the second position) that results in the plug/cap portion being separated from the bat portion of the assembly. As the batter swings the bat from the first position to the second position, the plug/cap portion will be propelled away from the batter and/or bat, where the resulting direction and distance of the plug/cap is indicative of the user's swing. For example, the direction the plug/cap travels is indicative of the correctness of the batter's swing, the distance the plug/cap travels is indicative of the power of the batter's swing, and so forth.

Figure 5:
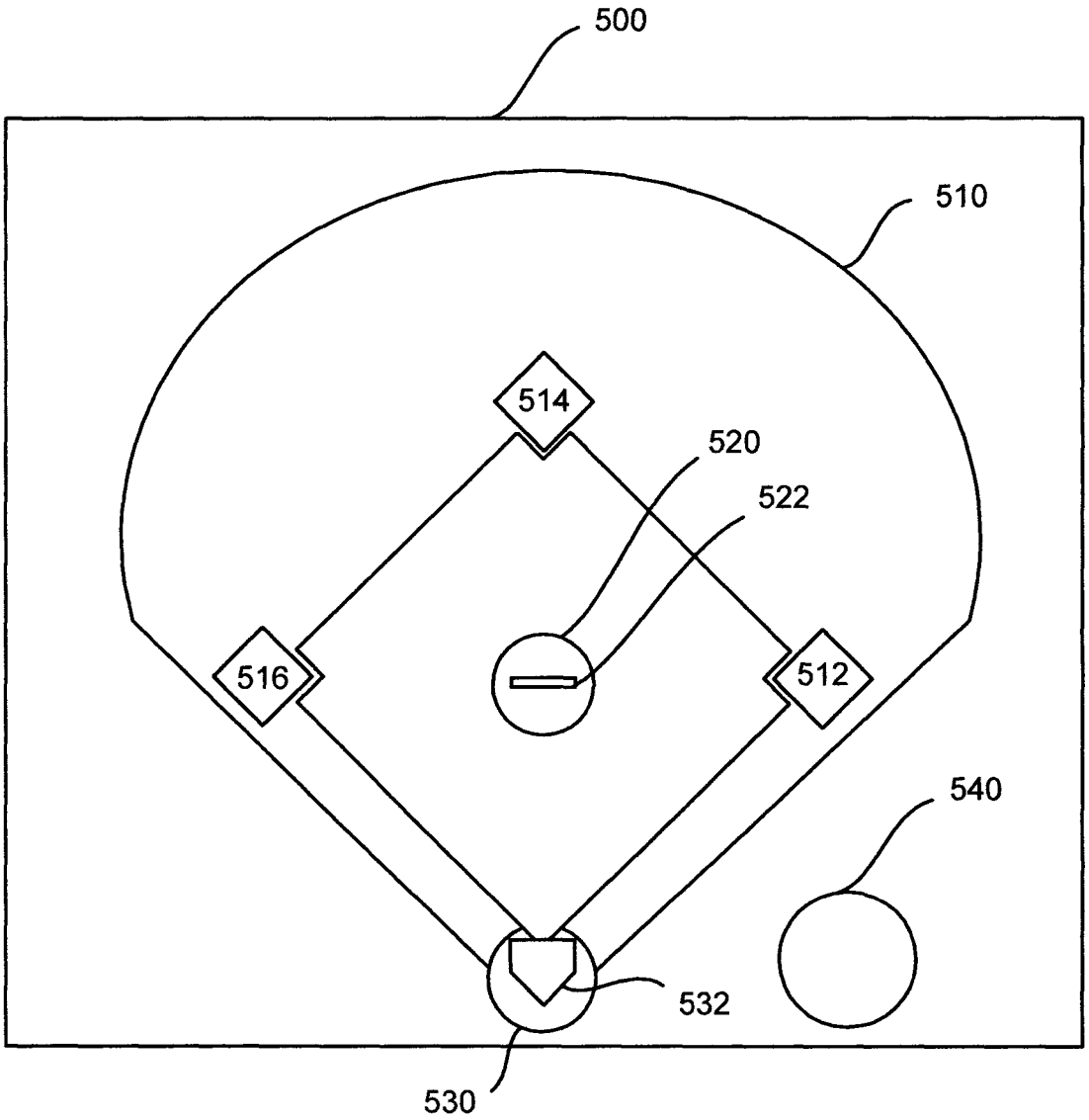
FIG. 5 illustrates a layout in accordance with one embodiment of the present invention, the layout including a plurality of standard and non-standard baseball diamond markings (e.g., home plate, a circle around home plate, a circle to the side of home plate, etc.).

FIG. 5 illustrates a layout that may be used in one embodiment of the present invention. In this embodiment, the layout 500 includes a plurality of markings, some of which are standard markings (i.e., markings that may be found on a typically baseball diamond), and some of which are non-standard markings (i.e., markings that are generally not found on a baseball diamond). For example, the layout 500 may include an outfield 510, first base 512, second base 514, third base 516, home plate 532 and a pitcher's plate 522 (i.e., standard markings). Such markings add realism, thereby enhancing the experience for the user. The layout 500 may also include a circle around home plate 530, a circle toward the first base dugout 540, and/or a circle around the pitcher's plate 520 (i.e., non-standard markings). These markings help the user determine whether their swing is correct (or close to being correct), and if not, what the user is doing wrong.

For example, in the case of a right-handed batter, if the batter swings with an "arm bar," i.e., with a stiff straight front arm with a locked elbow, or with "long arms," i.e., with his/her arms reaching too far away from his/her body, but not totally straight, then the plug/cap will be propelled from the bat and fall into the area defined by circle 540. Likewise, if the batter swings with too much chest rotation, i.e., first opens up his/her chest and then drags his/her hands though the strike zone, the plug/cap will also be propelled into the area defined by circle 540. If the batter drops his/her hands low and then swings up, or drops his/her hands and then swings flat, then the plug/cap will fall from the training bat and fall next to or behind the batter, i.e., in the area defined by the circle 530. In contrast, if the batter swings correctly, then the plug/cap will fly towards the pitcher's mound, and fall within the area defined by the circle 520. By noting where the plug/cap falls, the batter is able to adjust and correct his/her swing until all of his/her swings result in the plug/cap being directed toward the pitcher's mound (e.g., toward 520 or 522).

It should be appreciated that the present invention is not limited to the layout shown in FIG. 5. For example, the training bat assembly may be used on an actual field, with or without markings. Further, the layout may include additional or different markings (e.g., circles associated with other swinging problems, circles for left-handed batters, circles within circles (e.g., where the inner circle indicates perfection, the next circle out indicates slight imperfection, where the inner circle indicates a first problem, the next circle out indicates a different problem, etc.), etc.). Also, the layout may be configured for placement on a vertical substrate (e.g., a wall), and having the same or different markings (e.g., a left circle, a center circle, a right circle, etc.). It should be appreciated that the layout can be made using any material, including, but not limited to plastic, vinyl, Astro-Turf,™ or any other artificial grass or grass-like material, and any size (e.g., large for outdoor use or for use with adults, small for indoor use or for use with children, etc.). If the layout is configured for placement on a vertical substrate, the layout may be made of a material that allows a user to record (or identify) where the interaction between the layout and the plug/cap. This may be accomplished, for example, using a plug/cap that "sticks" to the layout using hook and loop fasteners (e.g., Velcro™).

While the present invention has been described herein in terms of a system and method for improving a user's swing of an apparatus, the present invention could also be used as a toy, a form of exercise, or a game. For example, markings could be placed on the layout, where the objective is to hit each marking (once or multiple times), or to accumulate a certain number of point (e.g., reaching or exceed a certain value or reaching zero, with different markings having different point values), similar to games that are played with darts (e.g., cricket, baseball, 501, 301, etc.).

Having thus described several embodiments of a system and method for improving a user's swing of an apparatus, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A training bat assembly, comprising:

a bat portion comprising a proximal end and a distal end, wherein a first portion at said proximal end of said bat portion is configured to be gripped by both hands of a user, said bat portion comprising an inner shaft that is accessible via an aperture in said distal end of said bat portion; and a plug portion comprising a cylindrical rod and a top, wherein said plug portion is configured to mate with said bat portion by sliding said cylindrical rod through said aperture and into said shaft, allowing said top to contact said distal end of said bat portion;

wherein said top is configured to remain in contact with said distal end of said bat portion when said user holds said bat portion in a first position, and to separate from said distal end of said bat portion when said user swings said bat portion from said first position to a second position, said first position comprising said distal end of said bat portion being behind said user and at a first elevation, and said second position comprising said distal end of said bat portion being in front of said user and at a second elevation, said second elevation being lower than said first elevation; and wherein said separation results in said plug portion being thrown away from said bat portion, at least one of a direction and a distance of said thrown plug portion indicative of said user's swing of said bat portion from said first position to said second position;

wherein a diameter of said shaft is larger than a diameter of said cylindrical rod, thereby providing a loose mating between said shaft and said cylindrical rod, allowing gravity to separate said ping portion from said bat portion at least when said bat portion is oriented vertically and said distal end of said bat portion is pointed downward; and wherein said cylindrical rod has a portion underneath said first portion of said bat portion when said plug portion is mated with said bat portion.

2. The training bat assembly of claim 1, wherein said top comprises a ball.

3. The training bat assembly of claim 1, wherein said cylindrical rod is substantially the same length as said shaft.

4. The training bat assembly of claim 1, wherein said shaft uses ball bearings to reduce friction between said cylindrical rod and said shaft.

5. The training bat assembly of claim 2, wherein said ball resembles a baseball and includes an outer circumference that is larger than an outer circumference of said distal end of said bat portion.

6. The training bat assembly of claim 1, wherein said plug portion is constructed using materials selected from a group consisting of metal, plastic, foam, and any combination thereof.

7. The training bat assembly of claim 1, wherein said distal end of said bat portion has an outer circumference that is substantially the same as an outer circumference of said proximal end of said bat portion.

8. The training bat assembly of claim 1, wherein said first portion comprises grooves allowing said hands of said user to better grip said bat portion.

9. The training bat assembly of claim 1, wherein said length of said bat portion is between eight and eighteen inches.

10. The training bat assembly of claim 1, further comprising a layout having a plurality of baseball diamond markings, at least one marking indicative of a proper swing, and at least one marking indicative of an improper swing.

11. The bat assembly of claim 1, wherein top resemble a baseball.

12. The training bat assembly of claim 1, wherein said length of said bat portion is approximately twelve inches.

13. The training bat assembly of claim 1, wherein said length of said bat portion is approximately eleven inches.

14. The training bat assembly of claim 1, wherein said diameter of said top is equal to a diameter of said distal end of said bat portion.

15. The training bat assembly of claim 1, wherein a length of said plug portion is approximately nine inches.

16. The training bat assembly of claim 1, wherein said loose mating between said shaft and said cylindrical rod includes a one-eight difference between said diameter of said cylindrical rod and said diameter of said shaft.

17. The training bat assembly of claim 1, wherein said training bat assembly is constructed using materials selected from a group consisting of wood, plastic, fiberglass, carbon fiber, foam, and any combination thereof.

18. The training bat assembly of claim 17, wherein said bat portion is constructed using plastic.

19. The training bat assembly of claim 17, wherein said bat portion is constructed using a first material and said plug portion is constructed using a second material.

20. The training bat assembly of claim 1, wherein gravity is sufficient to separate said top from said distal end of said bat portion when said distal end of said bat portion is moved to point downward.

* * * * *